US005190021A

United States Patent [19]

Hull et al.

[11] Patent Number: 5,190,021

[45] Date of Patent: Mar. 2, 1993

[54] QUICK RELEASE FOOT STRAP

[76] Inventors: Harold L. Hull, 401 Canyon Way #43, Sparks, Nev. 89434; Willard S. Haynes, P.O. Box 241, Doyle, Calif. 96109

[21] Appl. No.: 740,147

[22] Filed: Aug. 5, 1991

[51] Int. Cl.[5] ..... F41B 3/02

[52] U.S. Cl. ..... 124/20.1; 124/17; 124/35.1

[58] Field of Search ..... 124/17, 20.1, 20.3, 124/90, 91, 35.1; D21/2, 210; D22/106; 74/512, 564, 594.4, 594.6; 297/423, 438; 446/64, 65

[56] References Cited

U.S. PATENT DOCUMENTS

| | | | |
|---|---|---|---|
| D. 305,342 | 1/1990 | Magnuson | D21/2 |
| 402,130 | 4/1889 | Bedford | 74/564 X |
| 3,101,704 | 8/1963 | McCormick | 124/20 |
| 3,277,878 | 10/1966 | Pankratz | 124/20 |
| 3,299,564 | 1/1967 | Quercetti | 46/74 |
| 3,375,815 | 4/1968 | Novak | 124/91 X |
| 3,756,215 | 9/1973 | Black | 124/91 |
| 3,937,205 | 2/1976 | Saunders | 124/91 |
| 4,240,396 | 12/1980 | Randoll | 124/17 |
| 5,127,389 | 7/1992 | Magnuson | 124/17 |

FOREIGN PATENT DOCUMENTS

| | | | |
|---|---|---|---|
| 904874 | 2/1954 | Fed. Rep. of Germany | 124/20.1 |
| 9102938 | 3/1991 | PCT Int'l Appl. | 124/17 |

*Primary Examiner*—Randolph A. Reese
*Assistant Examiner*—Jeffrey L. Thompson

[57] ABSTRACT

An improved foot strap used in conjunction with a balloon launcher which provides rollers such as beads on the strap to reduce friction when the strap is released. Retaining beads are also provided to hold the roller or rollers in a central position on the strap.

1 Claim, 2 Drawing Sheets

Fig 1
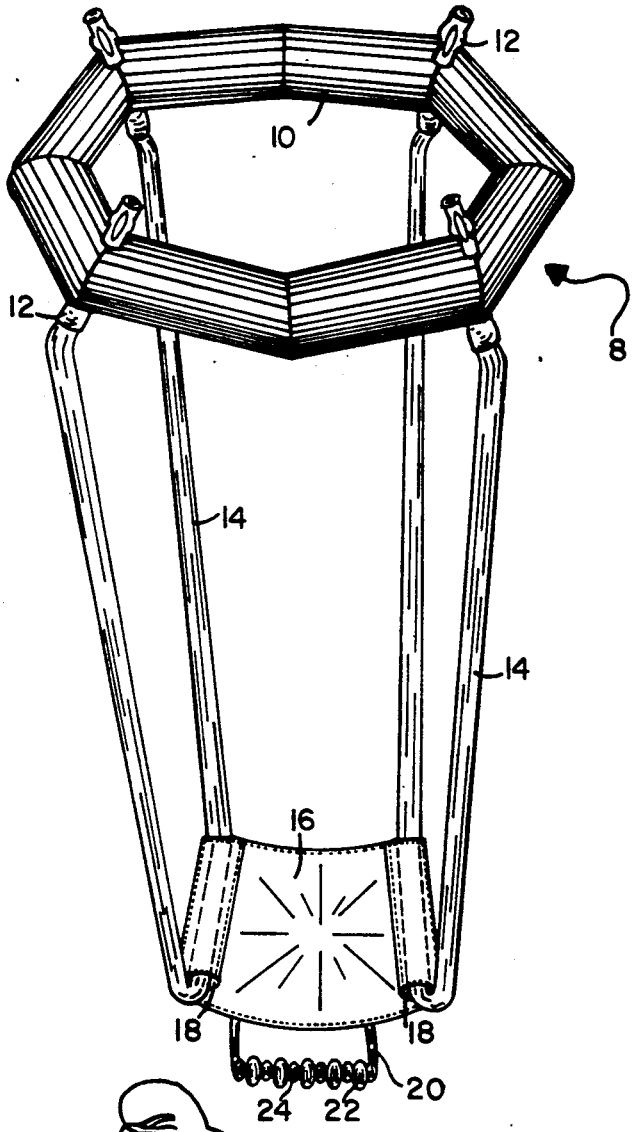
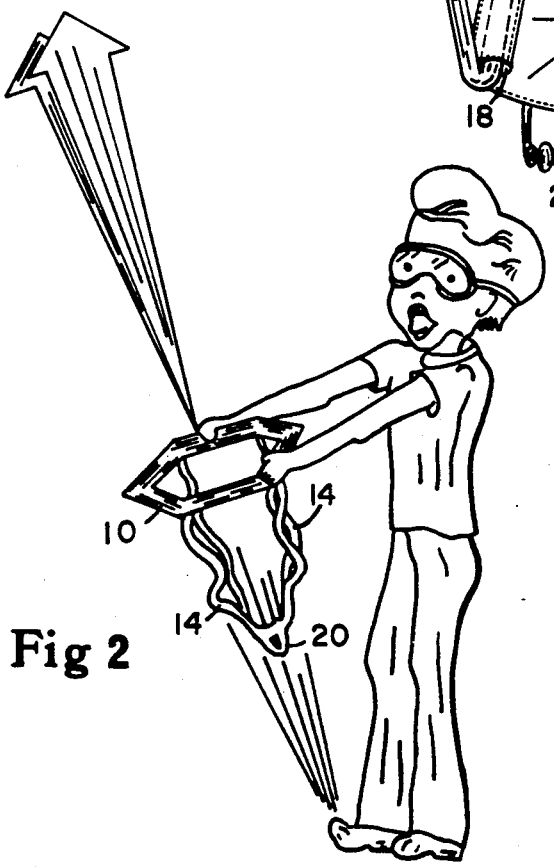
Fig 2
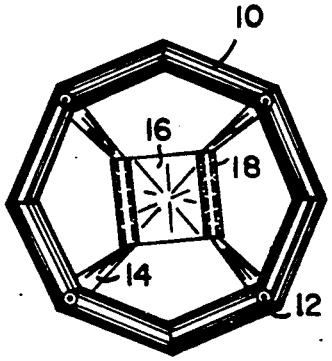
Fig 3

QUICK RELEASE FOOT STRAP

TECHNICAL FIELD

This invention relates to water-balloons or baseball launchers or the like and more particularly to a launcher that is activated by using the foot or toe to release a strap attached to a pocket containing the balloon or baseball or other projectile.

BACKGROUND OF THE INVENTION

In the past, a number of devices have been taught which provide means to launch balloons or baseballs or other objects, one being the well known "sling shot" such as U.S. Pat. No. #3,101,704 which is basically a fork with a handle and two elastic bands attached to the fork providing the propelling means.

Many other devices have been proposed such as the baseball throwing machine of U.S. Pat. No. #3,277,878 or the balloon launcher of U.S. Pat. No. #4,240,396 requiring at least three persons to operate.

Only a few attempts have been made to free up both hands to operate handles or rings which are attached to a pouch or release mechanism by multiple elastic members and which use at least one foot to hold down the pouch or release mechanism.

One such device is U.S. Pat. No. #3,299,564 which utilizes a foot-rest which the launcher holds firmly against the ground by placing his foot upon it and to which is hooked the rear part of the object to be launched, while the elastic cords of the catapult are attached to this object and are stretched.

Another device, namely the U.S. Pat. No. Des. #305,342 shows a foot strap attached to the bottom of a pouch containing an object to be launched.

Still another device is taught by co-pending application Ser. No. #395,511 filed Aug. 18, 1989 by one of the inventors of the present invention which also teaches a foot or toe strap attached to the bottom of a pouch containing an object to be launched.

While the above foot and toe straps have proven somewhat successful, in actual usage, the strap tends to bind on the foot or toe when attempting to release it as the friction between the strap and the shoe or foot of the launcher is quite severe under the stress created by stretching the elastic members and the foot or toe must be lifted to a substantial angle to allow the strap to slip off the shoe or foot.

OBJECTS AND ADVANTAGES

It is a primary object, therefore, of the present invention to provide a strap which does not bind on the foot or shoe of the launcher when in a release position.

It is a further object to provide a strap which may be attached to any pouch or receptacle in which a foot or toe is used as a holding means and which may be released with a minimum amount of friction.

It is a further object to provide a substantially elongated, flexible support member such as a cord, strap, tubular structure or the like, which is surrounded by an annular member such as a bead which can turn freely on the flexible member to substantially reduce friction.

It is still another object to provide in one embodiment, multiple annular members such as beads, which substantially cover the support member.

In still another embodiment, it is an object to provide a spring as the annular member to substantially cover the support member.

In yet another embodiment it is an object to provide multiple sections of tubular members as the annular members.

It is still a further object to provide friction held retaining members which may be used in cooperation with the free turning annular member or members to hold the free turning member or members in a fixed relationship with the support member.

Other objects advantages will become apparent when taken into consideration with the following drawings and specifications.

SUMMARY OF THE INVENTION

In accordance with the preferred embodiment of the present invention, a substantially elongated, flexible support member is provided such as a strap or cord which may be made of fiber, cloth, plastic or other suitable material, over which is placed multiple annular members such as beads which may be made of plastic or wood or other suitable material, with some of the beads being smaller than the others and acting as retaining members to hold the larger, free turning beads in a fixed relationship with the strap, whereby, when the strap is suitably affixed at each of it's ends to a pouch or receptacle and a foot or toe is placed on the strap between the strap and the pouch, the foot rests on the free turning beads, thus, when the foot is raised at a slight angle to the plane of the strap, the strap is freely released from the foot with a minimum amount of friction.

BRIEF DESCRIPTION OF THE DRAWINGS

FIG. 1 is a perspective view of the quick release toe strap affixed to the pouch of a balloon or baseball launcher.

FIG. 2 is a schematic view which shows how the launcher with the quick release toe strap is used.

FIG. 3 is a top view of the top side of the pouch.

DETAILED DESCRIPTION OF THE DRAWINGS

Figure 4:
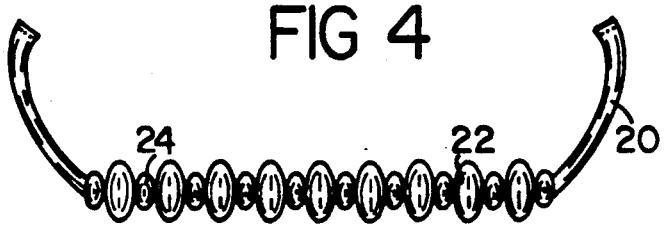
FIG. 4 is a perspective view of a strap with annular members being beads.

Referring now to the drawings wherein like characters refer to like elements throughout the various drawings, 8 is an overview of the preferred embodiment of the quick release strap suitably attached to a balloon launcher with 10 being an octagonal, substantially round, tubular base with 12 being mounting holes for elastic tubular thrust bands 14, elastic tubular thrust band 14 being of a sufficient length to allow the user to stretch them substantially from the ground to a position which places the base into a position in front of and above the head while 16 is a pouch or pocket containing sleeves 18 which capture elastic, tubular thrust bands 14 with 20 being a foot or toe strap suitably affixed to the pouch or pocket 16, with 22 being annular members such as free turning beads while 24 are retaining beads with their inside diameter holes being of a smaller size than the inside diameter holes of the free turning beads 22. The retaining beads cooperate with the strap 20 to hold the free turning beads 22 in a fixed relationship with strap 20.

Figure 5:
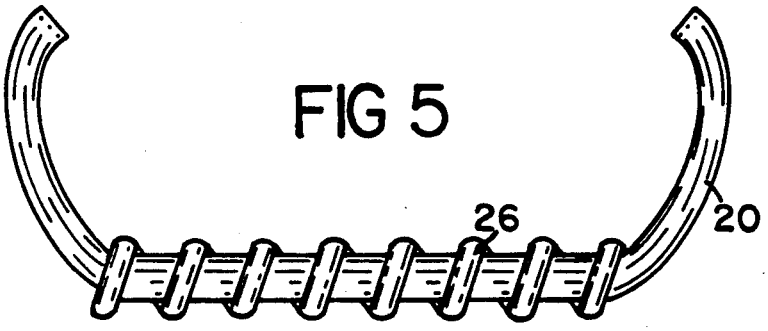
FIG. 5 is a perspective view of a strap with annular member being a spring.

In a second embodiment as shown in FIG. 5, 26 is a spring which captures strap 20 but is of a size and shape to turn freely on strap 20 even when in a curved position.

Figure 6:
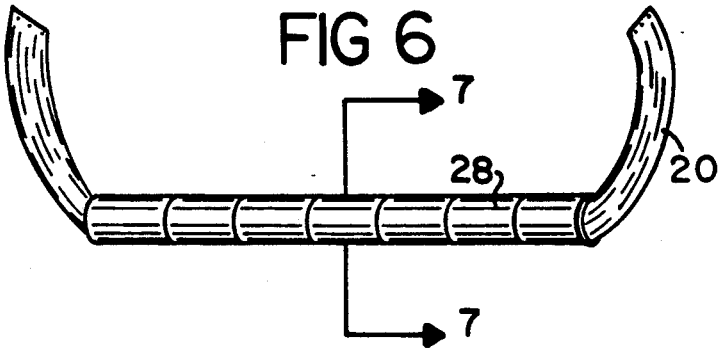
FIG. 6 is a perspective view of a strap with annular member being a tubular section.
Figure 7:
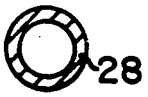
FIG. 7 is a cross section taken at 7—7.

FIG. 6 depicts yet another embodiment with 28 being tubular, annular sections which turn freely on strap 20.

It will now be seen that we have provided an improved foot or toe strap that when adapted to be used with a balloon or baseball launcher will not bind on the foot or shoe of the person using the launcher.

It will also be seen that we have provided a strap which may be attached to any pouch or receptacle in which a foot or toe is used as a holding means and which may be released with a minimum amount of friction.

Also, we have provided a substantially elongated, flexible support member such as a cord, strap or tubular member or the like which can be made of fiber, cloth, plastic or other suitable material, over which may be placed annular members such as beads, tubular sections which may be made of plastic, or a spring, which allows the support member to be freely released from the foot with a minimum amount of friction.

We have also provided retaining means in the form of beads which frictionally engage the support member to hold the free turning annular member or members in a fixed relationship with the support member.

Although the invention has been shown and described in what is conceived to be the most practical and preferred embodiments, it is recognized that departures may be made therefrom within the scope and spirit of the invention, which is not to be limited to the details disclosed herein but it is to be accorded the full scope of the claims so as to embrace any and all equivalent devices and apparatus.

Having described our invention, what we claim as new and desire to secure by letters patent is;

1. A device for launching objects, comprising:

a base adapted to be held by a user;

a plurality of elongate elastic thrust bands fixed to the base and extending downwardly therefrom;

a pouch supported by a lower end of the thrust bands and adapted to receive objects for launching; and a foot strap affixed to the pouch;

characterized in that the foot strap includes a substantially elongated flexible support member, at least one annular member, said annular member being freely rotatable on said support member, and retaining means to hold said annular member in position on said support member.

* * * * *